US008418484B2

(12) United States Patent
Petrenko et al.

(10) Patent No.: US 8,418,484 B2
(45) Date of Patent: Apr. 16, 2013

(54) COMPACT HELICAL HEAT EXCHANGER WITH STRETCH TO MAINTAIN AIRFLOW

(75) Inventors: Victor Petrenko, Lebanon, NH (US); Charles R. Sullivan, West Lebanon, NH (US)

(73) Assignee: The Trustees of Dartmouth College, Hanover, NH (US)

( * ) Notice: Subject to any disclaimer, the term of this patent is extended or adjusted under 35 U.S.C. 154(b) by 1477 days.

(21) Appl. No.: 12/022,905

(22) Filed: Jan. 30, 2008

(65) Prior Publication Data

US 2009/0188658 A1 Jul. 30, 2009

(51) Int. Cl.

| | |
|---|---|
| ***F25B 47/00*** | (2006.01) |
| ***F25B 47/02*** | (2006.01) |
| ***F28D 1/047*** | (2006.01) |
| ***F28D 11/06*** | (2006.01) |
| ***F28F 5/00*** | (2006.01) |
| ***F28F 13/08*** | (2006.01) |
| ***F28F 17/00*** | (2006.01) |
| ***F25D 21/06*** | (2006.01) |

(52) U.S. Cl.

USPC ..... 62/151; 62/150; 62/324.5; 165/231; 165/86; 165/95; 165/96; 165/163; 165/46

(58) Field of Classification Search ..... 165/86, 165/96, 95, 163, 231, 46; 62/151, 150, 324.5
See application file for complete search history.

(56) References Cited

U.S. PATENT DOCUMENTS

| | | | | |
|---|---|---|---|---|
| 3,046,758 | A | | 7/1962 | Heuer et al. |
| 3,359,750 | A | | 12/1967 | Hanson |
| 4,007,603 | A | * | 2/1977 | Gustafsson ..... 62/151 |
| 5,046,331 | A | * | 9/1991 | O'Neal et al. ..... 165/163 |
| 5,901,570 | A | | 5/1999 | Sin |

FOREIGN PATENT DOCUMENTS

| | | | | |
|---|---|---|---|---|
| DE | 3308714 | | | 10/1983 |
| EP | 1479987 | | | 11/2004 |
| FR | 2380700 | A | * | 10/1978 |
| FR | 2616215 | | | 12/1988 |
| JP | 63105399 | A | | 5/1988 |
| JP | 2267491 | A | | 11/1990 |
| JP | 07055295 | A | * | 3/1995 |
| JP | 2002235989 | A | | 8/2002 |
| JP | 2006220249 | A | * | 8/2006 |

OTHER PUBLICATIONS

PCT/US09/32663, International Search Report & Written Opinion mailed Aug. 4, 2009, 18 pages.

* cited by examiner

*Primary Examiner* — John Ford
(74) *Attorney, Agent, or Firm* — Lathrop & Gage LLP

(57) ABSTRACT

A heat exchanger for exchanging heat between gasses such as air and a liquid or gaseous coolant has narrow spacing between exchanger surfaces for high efficiency. To avoid undue obstruction of gas flow due to ice buildup on the exchanger surfaces, the heat exchanger is equipped with sensors to monitor the gas flow and an actuator that widens the spacing between exchanger surfaces such that gas flow remains unimpeded. Embodiments provide for defrosting of the exchanger surfaces when an limit on spacing of exchanger surfaces is reached, and for relaxing the spacing to the original narrow spacing when defrosting is completed.

2 Claims, 5 Drawing Sheets

COMPACT HELICAL HEAT EXCHANGER WITH STRETCH TO MAINTAIN AIRFLOW

FIELD

The present apparatus relates to the field of heat exchangers or evaporators for exchanging heat between a gas, such as air, and a coolant such as a refrigerant or other cold fluid.

BACKGROUND

It is known that a heat exchanger exchanges heat between a gas and a refrigerant more efficiently when the gas flows through spaces between exchanger surfaces that are narrow. In addition, more exchange surface can fit into a given volume if this spacing is narrow.

It is also known that, when the gas being cooled contains moisture, narrow spaces are far more prone to icing-up than when spaces are wide. Narrow-spaced heat exchangers are therefore often avoided when moisture-containing gasses, such as air, are to be cooled with coolant or refrigerant at, or below, the freezing point of water.

DETAILED DESCRIPTION OF THE EMBODIMENTS

Figure 1:
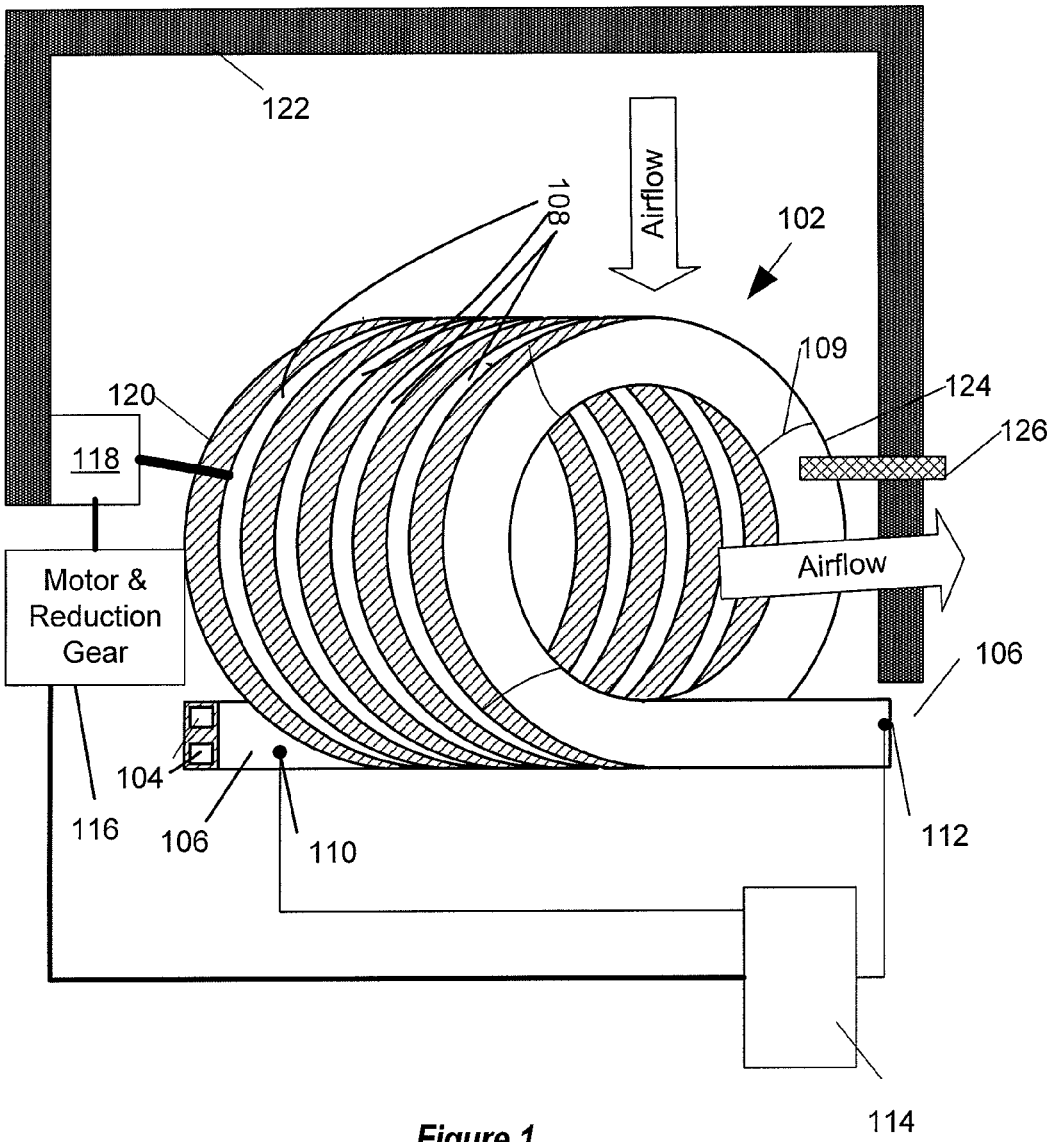
FIG. 1 illustrates a helical heat exchanger with stretching apparatus.

FIG. 1 illustrates an embodiment having a helically coiled microchannel refrigerant evaporator or coolant heat exchanger 102. The coiled microchannel heat exchanger has multiple passages 104 for refrigerant or other cold liquid or gaseous coolant running lengthwise through microchannel tubing 106. The microchannel tubing 106 is fabricated from a metal, a polymer, an electrically conductive polymer, or composite material that retains some deformability and springiness at low temperatures. The microchannel tubing is coiled such that a small space 108, typically less than two millimeters and in an embodiment one millimeter wide when not under tension, exists for airflow between the wider surfaces of the turns of the microchannel tubing. In some embodiments, a fiber 109, such as monofilament fishing line, is wound about the microchannel tubing, or spacers are provided, to maintain a minimum spacing between the coil turns when no tension is on the microchannel tubing. These spacers or fiber do not significantly disturbing the air flow, and are attached in such a way that the spaces 108 can expand when the helical-wound microchannel tubing is under tension.

In operation, air or other gas enters the evaporator through spaces 108 and exchanges heat with the tubing and coolant confined in passages 104, and the axis about which the coil is wound (the same axis as that along which air exits) is preferably horizontal so that melt water when the heat exchanger is eventually defrosted can drip downwards and therefore be removed from the exchanger. In an alternative embodiment, the air-flow direction is reversed from that illustrated in FIG. 1, entering along the axis and exiting through the spaces between the helical-wound tubing.

While the evaporator or heat exchanger of FIG. 1 is more compact and efficient than typical evaporators, prior devices have avoided tightly spaced heat exchangers such as these because they have a strong tendency to accumulate ice in spaces 108, with result that airflow becomes obstructed.

Ice accumulation in the present apparatus results in decreased airflow through the spaces 108, and decreased heat transfer from the coolant in the coolant passages 104. Hence, ice accumulation is detected by measuring pressure-drop across or/and airflow volume through the coil, or by measuring temperature differences between coolant input to the coil and coolant output from the coil. Ice accumulation may also be detected indirectly, through measurement of variables including fan speed, fan motor current and/or voltage, refrigerant pressure, and refrigerant compressor motor current and/or voltage.

Figure 2:
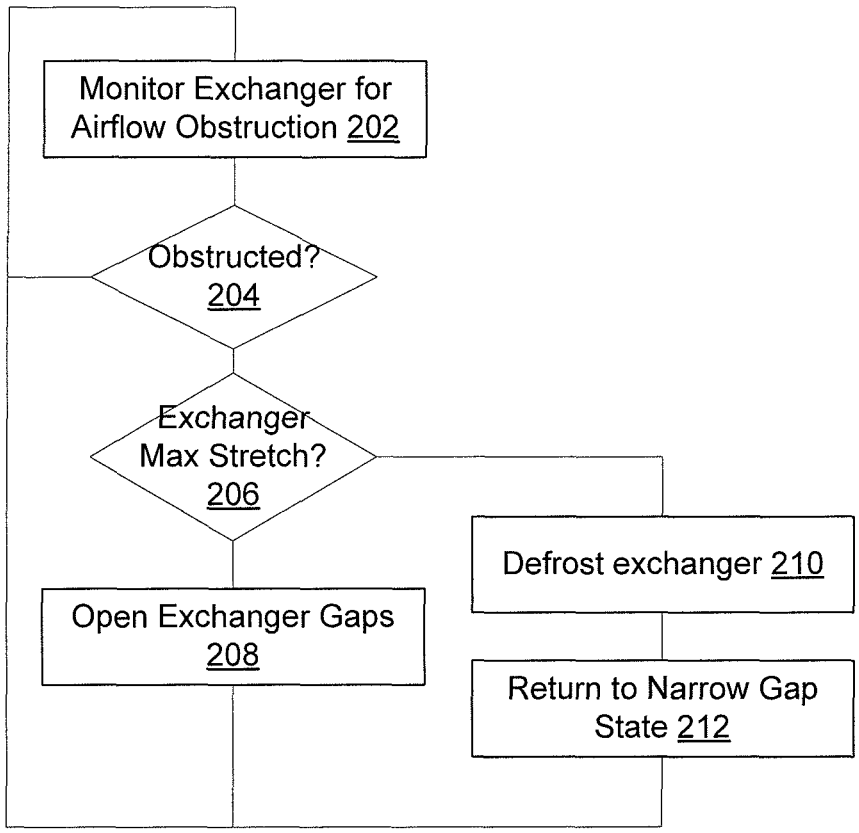
FIG. 2 is a flow chart of a method of operating the apparatus of FIG. 1.

In an embodiment, and with reference to FIG. 2 as well as FIG. 1, ice accumulation is detected by decreased difference between a temperature at microchannel tubing coil input, as measured by a thermistor 110, and temperature at coil output, as measured by a second thermistor 112, or by air pressure or airflow sensors (not shown). Air pressure and airflow sensors provide more direct measurement of airflow obstruction than coolant temperature difference, but it is expected that decreased coolant inlet and outlet temperature difference will result from impaired heat exchange due to airflow obstruction. These temperatures, pressures, or airflow are continually monitored 202 by a controller 114. When the controller 114 determines 204 that the heat exchanger (e.g. tubing 106) is partially iced over, but not already maximally stretched open 206, it activates an electric motor and reduction gear assembly 116, which in turn drives a rotary-to-linear motion conversion apparatus 118, to open the heat exchanger gaps 208, in the example of FIG. 1 by stretching the helix. In an embodiment rotary-to-linear motion conversion apparatus 118 is a rack-and-pinion; in another embodiment a rotating nut riding on a stationary screw; in another it has a steel cable that is wound onto a drum rotated by the motor and reduction gear assembly 116.

Conversion apparatus 118 is mounted to a rigid frame 122, and an end 124 of the coil of the helically-wound microchannel tubing 106 is attached by suitable attachment 126 to an opposing side of frame 122.

As the controller activates motor and reduction gear assembly 116, driving the rotary-to-linear motion conversion apparatus 118, tension is applied to an end 120 of the coil of the helically-wound microchannel tubing 106, such that the helically-wound tubing 106 is stretched towards conversion apparatus 118, thereby opening spaces 108 so that airflow can resume.

When the controller 114 determines that airflow is obstructed, but that the coil of the helically-wound microchannel tubing 106 is already maximally stretched 206 to a predetermined limit, it shuts down any refrigerant or coolant pump in the system for the duration of de-icing; and activates defrosting of the exchanger 210 in ways known in the art. Determination of stretch to the limit may be accomplished by detecting excessive current in the motor 116, by a limit switch, by an eddy-current proximity sensor, or by a photosensor. When defrosting is completed, controller 114 allows the resumption of coolant flow, and reverses motion of motor 116 to return the heat exchanger to the narrow-gap initial state 212, in the embodiment of FIG. 1 by allowing relaxation of stretch of helically-wound tubing 106, allowing helically wound tubing 106 to return to its unstretched state.

The apparatus of FIG. 1 therefore provides the advantage of narrow spacing of tubing in the heat exchanger, while permitting greater intervals between defrosting than those that would otherwise be necessary with narrow spaced heat-exchange surfaces.

Figure 3:
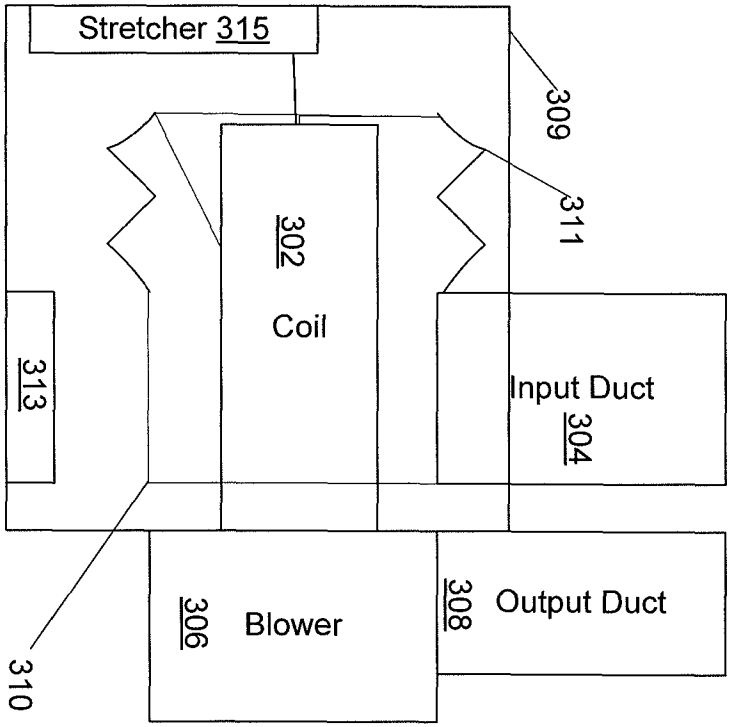
FIG. 3 illustrates a heat-exchanger system suitable for use with the heat exchanger of FIG. 1.

In the heat-exchange and cooling system of FIG. 3, a helically coiled microchannel heat exchanger 302 as described with reference to FIG. 1 is connected to a refrigerant compressor, orifice, and condenser as known in the art of refrigeration, or other source of chilled coolant, and not shown in the figure. The microchannel heat exchanger is coupled to serve as the refrigerant evaporator, or heat exchanger, while providing heat exchange to air or other gas. Air enters through input duct 304, and exits through a blower 306 and output duct 308. A rigid member of housing 309 serves as frame 122. The heat exchanger 302 is mounted within a plenum having a rigid portion 310 and a stretchable bellows portion 311. A controller 313 monitors the heat exchanger for airflow obstruction as heretofore described, and activates a stretcher 315, containing motor and reduction gear 116 and rotary to linear motion converter 118 to stretch the heat exchanger 302 to re-open airflow passages as heretofore described. When stretch reaches a limit, a defrosting cycle of the heat exchanger is activated 210. When defrosting is complete, the stretch of the heat exchanger is relaxed 212 to allow the helical heat exchanger to return to an unstretched state.

Figure 4:
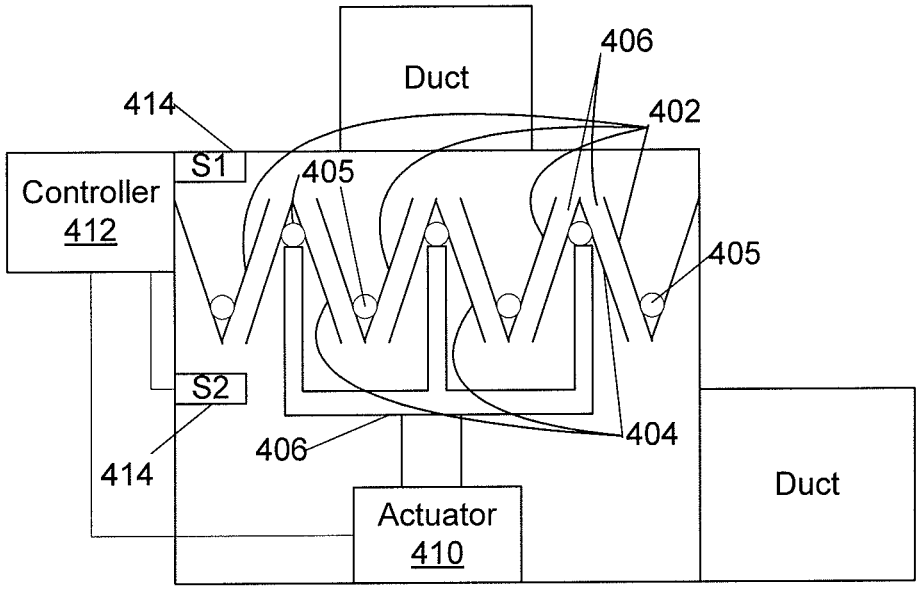
FIG. 4 illustrates an embodiment having two facing, interdigitated, multiple-wedge heat exchange surfaces, where a multiple-wedge surface moves to adjust heat-exchanger gap.

An alternative embodiment, as illustrated in FIG. 4, has multiple wedgelike heat-exchange surfaces 402, 404. Some of these heat exchange surfaces 402 form a first multiple-wedge surface, and are fixed to a frame (not shown) of the heat exchanger. A second group of these heat exchange surfaces 404 form a second multiple-wedge surface interdigitated with heat exchange surfaces 402 of the first multiple-wedge surface. Heat-exchange surfaces 404 of the second multiple-wedge surface are fixed to a movable element 406 of the heat exchanger. Heat exchange surfaces 402, 404, are either fabricated from microchannel tubing or are fabricated from thermally conductive fins in thermal contact with coolant tubes 405. Movable element 406 is attached to an actuator 410, that typically incorporates a motor, reduction gear, and one or more rotary-to-linear motion converters similar to those previously discussed. Between wedges 402 and 404 are gas passages 406. A controller 412 has sensors 414 for monitoring for airflow obstruction, and is coupled to drive actuator 410.

In operation, the controller 412 initially drives the movable element 406 to a position such that gas passages 406 are narrow. As moisture condenses out of the gas, such that ice accumulates on heat exchange surfaces 402, 404, sensors 414 detect airflow obstruction; in response to the airflow obstruction controller 412 causes the actuator 410 to open gas passages 406 to allow heat exchange to continue. Eventually, at convenient times or when actuator 410 has reached a maximum spacing between surfaces 402, 404 and airflow is still obstructed, heat exchange surfaces 402, 404 are defrosted as known in the art.

Figure 5:
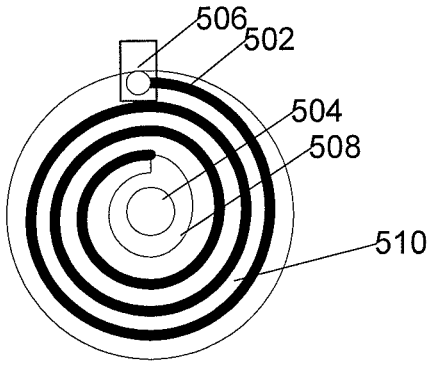
FIG. 5 illustrates an embodiment having a coiled microchannel embodiment in tight-wound condition.

In an embodiment having a heat exchange surface made from a spiral-wound microchannel tubing 502, FIG. 5, airflow is along the axis of the spiral. At the axis of the spiral, the microchannel tubing 502 attaches to a fitting 508 on an axle 504. The opposite end of the microchannel tubing 502 attaches to a fitting 506. Refrigerant flow through the microchannel tubing is either from fitting 506 to axle fitting 508, from axle fitting 508 to fitting 506, or, since microchannel tubing is available with more than one refrigerant or other coolant channel, both to and from the axle fitting 508, or both to and from fitting 506.

Figure 6:
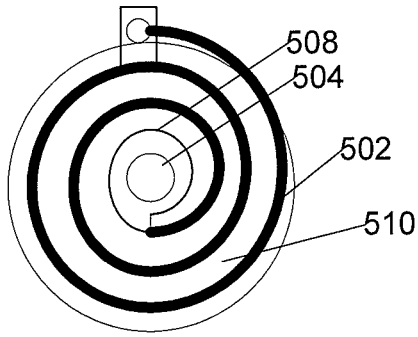
FIG. 6 illustrates the embodiment of FIG. 5 in unwound condition.

As illustrated in FIG. 6, with the embodiment of FIG. 5 rotation of axle 504 can relax the spiral wound microchannel tubing 502 such that a gas space 510 is enlarged, similarly rotation of axle 504 in an opposite direction can tighten the spiral wound microchannel tubing 502 such that gas space 510 is narrowed. As shown, outer end fitting 506 is allowed to move outward in the relaxed state to allow space 510 to be evenly distributed along the tubing 502.

Figure 7:
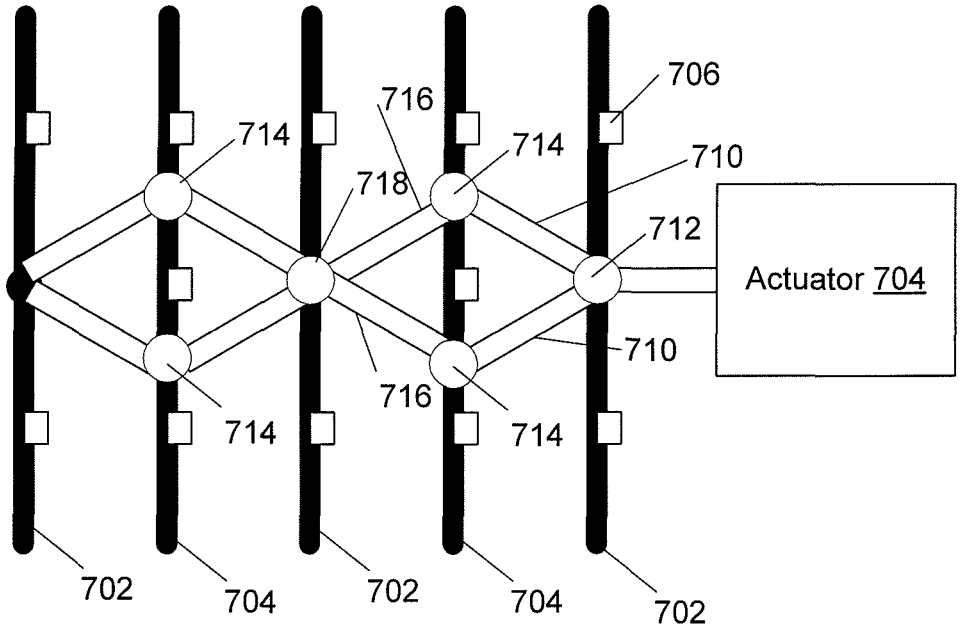
FIG. 7 illustrates an embodiment having parallel plates and apparatus to ensure even spreading.

In yet another embodiment, illustrated in FIG. 7, coolant tubing 706 is formed as part of or attached to cooling fins 702, 704. One or more of cooling fins 702 is anchored to a frame (not shown), and another 702 is attached to an actuator 708 as previously described. A mechanism for keeping even spacing between cooling fins 702, 704, and thereby ensuring an approximate match of spacing between cooling fins 702, 704, has a pair of rods 710. Rods 710 attach to a first fin 702 at a pivot 712, and to a second fin 704 at a pair of pivots 714 that are adapted to sliding along fin 704. Pivots 714 also attach to a pair of rods 716 that are coupled to a pivot 718 on another cooling fin 702, and to another slideable pivot 714 on another fin 704. The apparatus of FIG. 7 is fitted with airflow obstruction sensing devices and a controller as heretofore described, actuator stretches spacing between fins when ice accumulation obstructs airflow, and relaxes spacing between fins when ice is defrosted.

Figure 8:
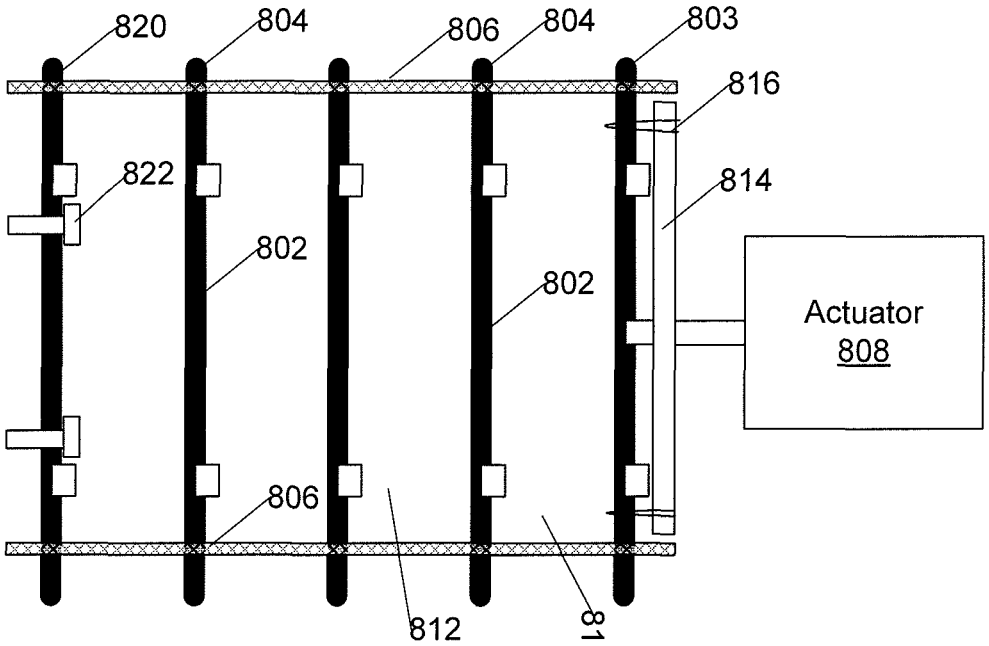
FIG. 8 illustrates an embodiment resembling that of FIG. 7, wherein elastomeric sheets are the apparatus to ensure even spreading.

In an embodiment, FIG. 8, resembling that of FIG. 7, cooling fins 802 have projections 804 that fit into holes in elastomeric sheets 806. When actuator 808 pulls a first fin 803 to enlarge a first air/gas space 810 between fins 802, pressure is applied to elastomeric sheets 806, which tend to stretch evenly thereby spreading a second air/gas space 812 and ensuring an approximate match of space 812 to space 810. The embodiment of FIG. 8 is fitted with a blower to move air, airflow obstruction detection apparatus and controller apparatus as previously discussed.

While the actuator 808 may attach directly to a cooling fin 803 if that fin is sufficiently thick and rigid, an optional, rigid, force-spreading bar 814 may be provided to spread force across the fin 803. If used, force-spreading bar 814 is attached, by wires 816, bolts, rivets, glue, or other methods known in the art, to cooling fin 803 and to the actuator. Similarly, end cooling fin 820 is securely attached, to a rigid wall (not shown) of an enclosure such as is illustrated in FIG. 3; bolts 822 are illustrated for attaching end cooling fin 820 to a wall.

Airflow may be reversed in any of the illustrated embodiments without departing from the spirit of the invention.

A system as herein described has potential to permit construction of a high efficiency, compact, heat exchanger where defrosting is delayed until convenient times. For example, an air conditioning system using a heat exchanger as herein described may be able to postpone defrosting until between two and four AM, when most buildings are unoccupied.

While the forgoing has been particularly shown and described with reference to particular embodiments thereof, it will be understood by those skilled in the art that various other changes in the form and details may be made without departing from the spirit hereof. It is to be understood that various changes may be made in adapting the description to different embodiments without departing from the broader concepts disclosed herein and comprehended by the claims that follow.

What is claimed is:

1. A refrigeration system having a heat exchanger for exchanging heat between a gas and coolant, the heat exchanger comprising:

a tubing having at least one coolant passage wound into a helical coil having a space between turns of the coil;

a blower for passing the gas through the space between turns of the coil;

apparatus for altering the coil from a first state wherein the space between turns of the coil is narrow into an altered state, the altered state having an increased space between turns of the coil; and apparatus for detecting obstruction of gas flow through the space between turns of the coil, and for activating the apparatus for altering the coil from the first state to the altered state when gas flow is obstructed;

apparatus for determining when the coil is in a maximally altered state, and for activating a defrost cycle of the refrigeration system when the coil is in a maximally stretched state;

wherein the space between turns of the coil is less than two millimeters wide when the coil is in the relaxed state.

2. A method of maintaining airflow through a heat exchanger subjected to potential ice accumulation in a space between heat exchange surfaces of the heat exchanger comprising:

detecting ice accumulation on the heat exchanger;

stretching the heat exchanger to widen the space between heat exchange surfaces of the heat exchanger;

activating a defrost cycle when the heat exchanger is stretched to a predetermined maximum; and relaxing the heat exchanger to an unstretched state when defrosting is complete.

* * * * *